US006334722B1

(12) United States Patent
Aoki et al.

(10) Patent No.: US 6,334,722 B1
(45) Date of Patent: Jan. 1, 2002

(54) INK RIBBON TAKE-UP BODY

(75) Inventors: Masahiro Aoki; Hiroaki Moriyama; Kimihiro Yagi, all of Osaka-fu (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 09/722,905

(22) Filed: Nov. 27, 2000

(30) Foreign Application Priority Data

Dec. 2, 1999 (JP) ..... 11-342855

(51) Int. Cl.[7] ..... B65H 75/00

(52) U.S. Cl. ..... 400/242; 400/208; 400/231; 400/234

(58) Field of Search ..... 400/208, 234, 400/231, 207

(56) References Cited

U.S. PATENT DOCUMENTS 5,100,250 A * 3/1992 Suzuki et al. ..... 400/208
5,738,448 A * 4/1998 Hara et al. ..... 400/231
RE36,953 E * 11/2000 Lodwig et al. ..... 400/234
6,161,972 A * 12/2000 Kameyama et al. ..... 400/208

FOREIGN PATENT DOCUMENTS

JP 2726856 12/1997

* cited by examiner

*Primary Examiner*—John S. Hilten
*Assistant Examiner*—Marvin P. Crenshaw
(74) *Attorney, Agent, or Firm*—Howson & Howson

(57) ABSTRACT

An ink ribbon take-up assembly for winding individual narrow ink ribbons produced in a slitting apparatus by slitting a wide ribbon, comprises a mounting shaft with a longitudinal groove, and ribbon cores and separators mounted alternately on the shaft. Each ribbon core has a longitudinally elongated projection on its inner surface, which is complementary to, and in engagement with, the groove in the shaft. The separators can be simple cylindrical tubes. This structure obviates cooperating notches and tabs at ends of the ribbon cores and separators, and makes it possible to achieve miniaturization by minimizing the wall thickness of the ribbon cores.

4 Claims, 3 Drawing Sheets

INK RIBBON TAKE-UP BODY

FIELD OF THE INVENTION

This invention relates to the manufacture of ink ribbons, and more particularly to improvements in ink ribbon take-up bodies adapted to take up narrow ink ribbons formed by longitudinal slitting of a wide ribbon.

BACKGROUND OF THE INVENTION

Recent advances have taken place in the miniaturization of printers, for example printers used in conjunction with digital cameras to produce high-quality printed images rapidly and easily. With miniaturization of printers, the need has arisen for miniaturized ink ribbons.

In general, an ink ribbon for a printer consists of a base made of paper or plastic film, having an ink layer disposed on one side. The ink ribbon is typically made by slitting a wide ribbon to produce plural ribbons of a predetermined smaller width. The narrow ribbons thus produced are usually stored in cassettes for shipment as end products.

This invention is concerned with a take-up body used to take up ink ribbons formed by slitting in the manner described. The wide ribbon prior to slitting and the ink ribbon, which is the narrow ribbon formed by the slitting process, have the same composition, differing from each other only in width.

Wide ribbons are typically slit to form ink ribbons by a slitting device of the kind disclosed in Japanese Patent No. 2726856.

In a conventional wide ribbon slitting device, a wide ink ribbon is unreeled from a supply roll, and slit longitudinally to form plural, separate, narrow, ink ribbons which are wound into reels on take-up cores.

In the slitting operation refuse strips are generated between adjacent ink ribbons. The generation of refuse strips results in the formation spaces between adjacent ink ribbons. Therefore, separators are generally utilized between ribbon take-up cores.

Ribbon cores and separators are installed alternately on an elongate core mounting shaft. Notches formed at axial ends of the ribbon cores are engaged by complementary projections on the separators so that the cores and separators rotate together.

In the assembly process, the ribbon cores and the separators are pushed axially onto the mounting shaft. A pin, extending through a radial bore in the wall of each separator engages a longitudinal groove formed in the core mounting shaft so that the separators and ribbon cores rotate with the shaft.

The assembly of the conventional ink ribbon take-up body is difficult and time-consuming because of the need to fit the projections of the separators into the notches of the ribbon cores, and the need to install the ribbon cores and separators on the shaft in the proper direction so that their respective notches and projections can engage one another.

As mentioned previously, miniaturization of ink ribbons is necessitated by the miniaturization of printers using them. But, there is a practical limit to the size reduction that can be achieved in the core mounting shaft. If the shaft is made too small in diameter, it will not have adequate mechanical strength.

The only alternative is to reduce the wall thickness of the ribbon core. However, since the projections of the separators must engage the notches of the ribbon cores in order for the separators and ribbon cores to rotate together, a relatively large stress is produced at the notches of the ribbon cores. Thus, if the walls of the ribbon cores are made too thin, there is a possibility that the notches will be damaged. Moreover, the reduction of the wall thickness of the ribbon core and the resulting reduction of its mechanical strength may even make it impossible to form the notch in some cases.

SUMMARY OF THE INVENTION

The principal object of the invention is to solve the aforementioned problems encountered in conventional ribbon take-up bodies and in efforts to miniaturize such bodies.

The ink ribbon take-up body in accordance with the invention comprises at least one cylindrical ribbon core for taking up a longitudinally slit ink ribbon and a ribbon core mounting shaft. Each ribbon core is mounted on the mounting shaft, and has an inner surface with an engaging part formed thereon. The mounting shaft, in turn, has an outer surface with an engaging part formed thereon. The engaging part of the mounting shaft is complementary to, and engaged with, the engaging part of each ribbon core so that the mounting shaft may rotate integrally with each ribbon core. The ink ribbon take-up body preferably comprises at least two such cylindrical ribbon cores, and at least one cylindrical separator, there being a said separator inserted between the cylindrical ribbon cores of each pair of adjacent ribbon cores. In a preferred embodiment, the engaging part formed on the inner surface of each ribbon core comprises a projection, and the complementary engaging part formed on the outer surface of the mounting shaft comprises a recessed groove. In each case, as a result of the cooperation of their complementary engaging parts, the ribbon cores and the ribbon core mounting shaft rotate as an integral body, and the wound ink ribbon assembly can be miniaturized by reducing the wall thickness of the ribbon core.

Other objects, details and advantages of the invention will be apparent from the following detailed description when read in conjunction with the drawings.

BRIEF DESCRIPTION OF THE DRAWINGS

FIG. 1(*b*) is a radial cross-section taken on plane b—b of FIG. 1(*a*);

FIG. 1(*c*) is a radial cross-section taken on plane c—c of FIG. 1(*a*);

FIG. 3(*b*) is a radial cross-section taken on plane b—b of FIG. 3(*a*); and FIG. 3(*c*) is a radial cross-section taken on plane c—c of FIG. 3(*a*).

DETAILED DESCRIPTION

Figure 2:
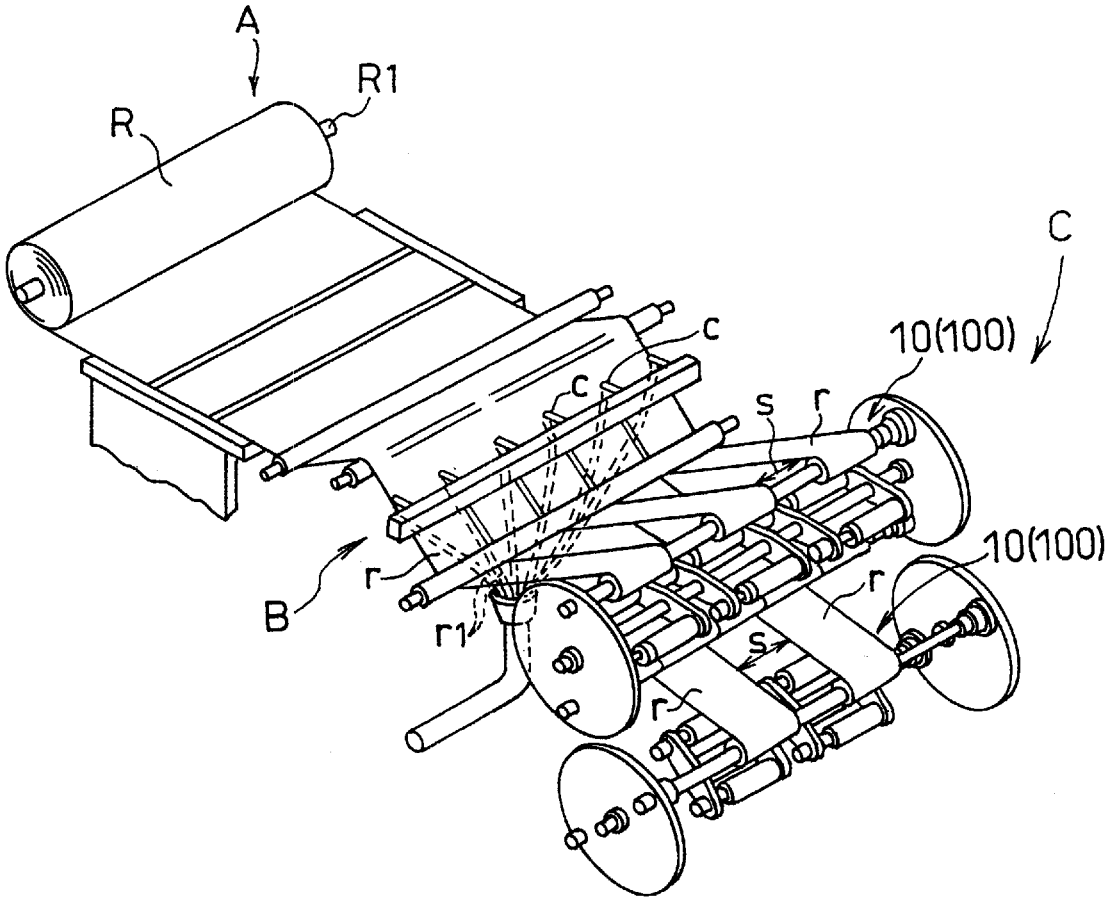
FIG. 2 is a perspective view of a wide ribbon slitting device.

The wide ribbon slitting device shown in FIG. 2 comprises a drawing out section A, a slitting section B and a reeling section C. In the drawing out section A, a wide ink ribbon R, supplied as a roll on a supporting shaft R1, is unreeled and delivered to the slitting section B, where it is slit longitudinally by a plurality of cutters c, to form plural, separate, narrow, ink ribbons r. The narrow ink ribbons r are wound into reels in the reeling section C.

Figure 3A:
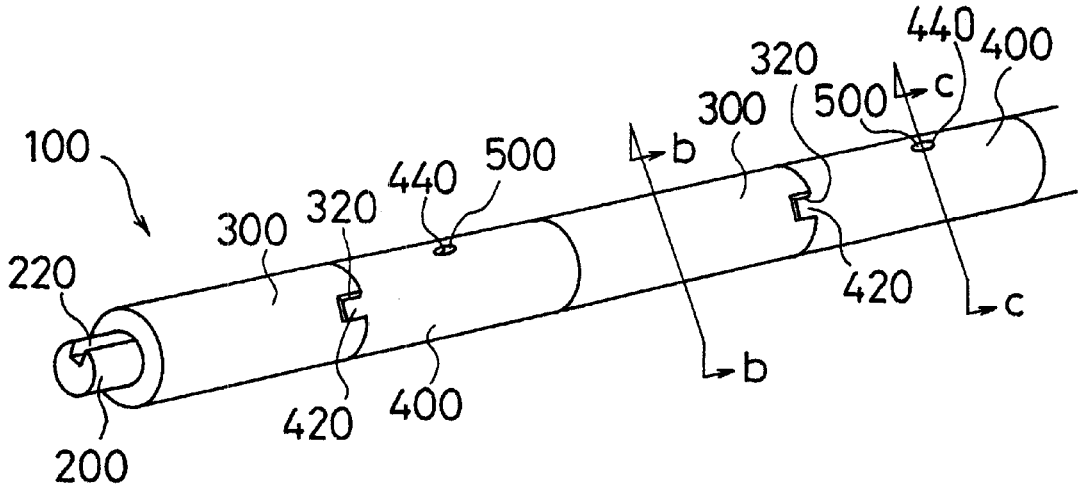
FIG. 3A PRIOR ART
FIG. 3(*a*) is a perspective view of a conventional ink ribbon take-up body.
Figure 3B:
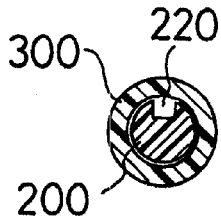
FIG. 3B PRIOR ART
Figure 3C:
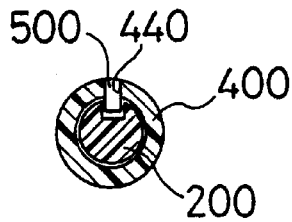
FIG. 3C PRIOR ART

In the conventional slitting device, the reeling section utilizes take-up bodies as illustrated in FIGS. 3(*a*)–3(*c*). As shown in FIG. 2, the ink ribbons emerging from the slitting section B are divided alternately into upper an lower ribbons, the upper ribbons being wound onto an upper ribbon take-up body 100, and the lower ribbons being wound onto a lower ribbon take-up body 100. As the ink ribbons are formed in the slitting operation, refuse strips r1 are generated between adjacent ink ribbons. The generation of refuse strips results in the formation spaces s between adjacent ink ribbons r. As shown in FIG. 3(*a*), in order to avoid a space between cylindrical ribbon cores 300, separators 400 are utilized. (In the case of relatively wide ink ribbons r, the separators may be eliminated, and the ribbon cores can be fixed at both ends to their mounting shaft by stop rings.)

In the ink ribbon take-up body 100, the cylindrical ribbon cores 300 and the separators 400 are installed in alternation on an elongate core mounting shaft 200. The shaft 200 is formed with a longitudinal groove 220. A notch 320 is formed at one axial end of each ribbon core 300, and a complementary projection 420 is formed at one axial end of each separator 400. The notch and complementary projection are adapted to engage with each other so that each ribbon core rotates with an adjoining separator.

When the ink ribbon take-up body 100 is installed in a wide ribbon slitting device, the ribbon cores 300 and the separators 400 are pushed axially onto shaft 200 from both ends of the take-up body, so that spaces between the ribbon cores 300 and separators 400 are eliminated. As shown in FIG. 3(*c*), a radial bore 440 is provided in the wall of the separator 400. A pin 500, inserted into the bore 440, is adapted to engage with the groove 220 of the core mounting shaft 200.

The core mounting shaft 200 and the separators 400 are integrated by the pins 500 so that the shaft and separators rotate together. In turn, the ribbon cores rotate with the mounting shaft because the ribbon cores and the separators are integrated by the cooperation of notches 320 and projections 420.

The process of assembling the conventional ink ribbon take-up body 100 is time-consuming because of the need to fit the projections 420 of the separators 400 into the notches of the ribbon cores. Further difficulties are encountered when, as in FIG. 3, the projections are formed only at one end of the separators and the notches are formed only at one end of the ribbon cores, because it is then necessary to ensure that each of these elements is mounted on the shaft 200 in the correct direction.

For miniaturization, either the shaft 200 must be made smaller in diameter, in which case it is necessarily weakened, or the wall thickness of the ribbon core 300 must be reduced, in which case the mechanical strength of the cores will be reduced, and the notches at their ends may be either subject to damage or difficult to form.

Figure 1A:
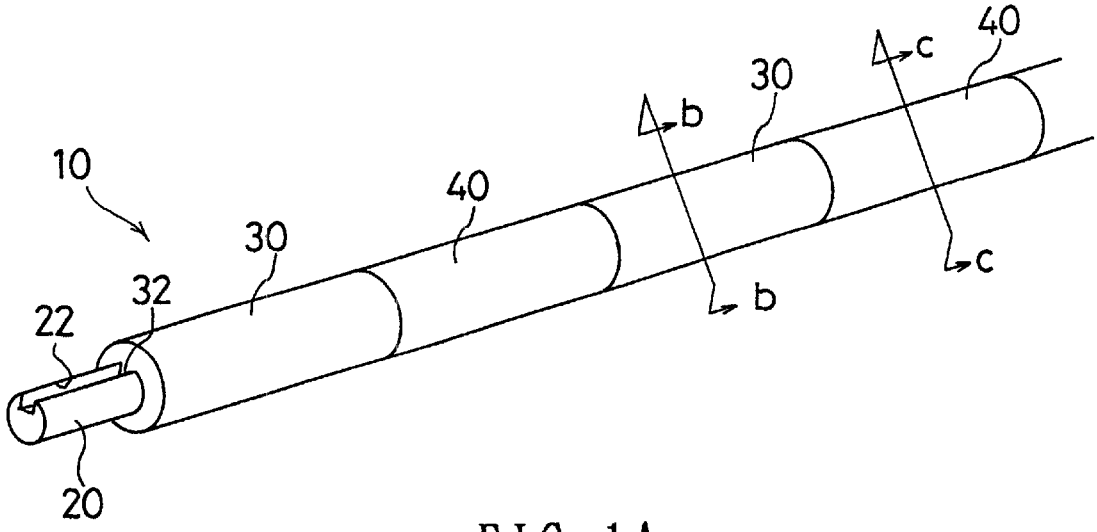
FIG. 1(*a*) is a perspective view of an ink ribbon take-up body in accordance with the invention.
Figure 1B:
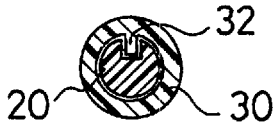
Figure 1C:
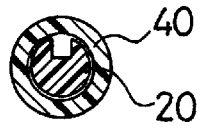

The ink ribbon take-up body 10 in accordance with the invention, as illustrated in FIGS. 1a–1c, is used in a wide ribbon slitting device as shown in FIG. 2 in place of the conventional ink ribbon take-up body 100. As in the case of the conventional take-up body 100, the take-up body 10 comprises a core mounting shaft 20, ribbon cores 30 and separators 40. Moreover, a longitudinal, recessed groove is formed in the mounting shaft 20.

As shown in FIGS. 1a and 1b, a projection 32 is formed on the inner surface of each cylindrical ribbon core 30. The projection is preferably elongated and preferably extends axially along the full length of the ribbon core. The projection 32 is shaped to fit into the recessed groove 22 of the core mounting shaft 20. Although an elongated projection, extending the full length of the ribbon core, is preferred both because of its strength, and the ease with which it can be formed, it is possible to utilize one or more axially shorter projections.

By the engagement of the projections 32 with groove 22, the rotation of the core mounting shaft 20 is transmitted directly to the ribbon cores when the ribbon cores are installed on shaft 20.

To eliminate the spaces between ribbon cores 30, separators 40 are provided. The separators and the ribbon cores on the shaft 20 are usually pushed inwardly from the ends of the ink ribbon take-up body 10. The separators are rotated along with the ribbon cores by the frictional force between the ribbon cores and the separators, and between the ribbon cores and the mounting shaft. Consequently there is ordinarily no relative rotation between the ribbon cores and the separators.

The separators 40 may therefore have a simple cylindrical, tubular shape, as shown in FIG. 1c, without the need for any special engaging part for cooperation with the groove 22 of the mounting shaft 20.

It will be apparent that, with the invention, the engagement of the projection 32 on the inner surface of the ribbon core 30 with the groove 22 on the ribbon core mounting shaft 20 ensures that the shaft and all of the ribbon cores mounted thereon rotate as an integral body. Thus, even if the wall of the ribbon core 30 is made quite thin, the ribbon core is not easily damaged. Moreover, the installation of the ribbon cores and spacers on the mounting shaft is simplified because there is no need to consider the orientation of either element when it is installed on the shaft.

In summary, the invention has several advantages. First, it permits the ink ribbon assembly to be miniaturized by reducing the wall thickness of the ribbon core. Secondly, it allows the separators to be formed in a simple, cylindrical shape so that their manufacturing cost is decreased. Finally, the mounting procedure is simplified because there is no need to be concerned about the direction in which the ribbon cores and separators are oriented when they are installed on the mounting shaft.

The manner in which the ribbon core is installed on the mounting shaft may be modified. For example, it is possible to provide a convex part, for example an elongated key structure on the exterior of the mounting shaft and a complementary recessed groove on the interior surface of the ribbon core. Still other modifications may be made to the apparatus and method described above without departing from the scope of the invention as defined in the following claims.

We claim:

1. An ink ribbon take-up body comprising a plurality of cylindrical ribbon cores for taking up a longitudinally slit ink ribbon and a ribbon core mounting shaft having an outer surface with a uniform, non-circular, cross-sectional shape along at least part of its length, said non-circular cross-sectional shape providing the outer surface with an engaging part for engagement with said ribbon cores, each said ribbon core being slidably mounted on the mounting shaft on said part of the length thereof, each ribbon core having an inner surface with an engaging part integrally formed thereon, the engaging part of the mounting shaft being complementary to, and engaged with, the engaging part of each said ribbon core so that the mounting shaft may rotate integrally with each ribbon core.

2. An ink ribbon take-up body according to claim 1, comprising at least two said cylindrical ribbon cores, and at least one cylindrical separator, there being a said separator inserted between the cylindrical ribbon cores of each pair of adjacent ribbon cores.

3. An ink ribbon take-up body according to claim 1, in which the engaging part formed on the inner surface of each ribbon core comprises a projection, and the complementary engaging part formed on the outer surface of the mounting shaft comprises a recessed groove.

4. An ink ribbon take-up body according to claim 3, comprising at least two said cylindrical ribbon cores, and at least one cylindrical separator, there being a said separator inserted between the cylindrical ribbon cores of each pair of adjacent ribbon cores.

* * * * *